US011739518B2

(12) United States Patent
Shiohara et al.

(10) Patent No.: US 11,739,518 B2
(45) Date of Patent: Aug. 29, 2023

(54) FLUSH TOILET

(71) Applicant: TOTO LTD., Kitakyushu (JP)

(72) Inventors: Eiji Shiohara, Fukuoka (JP); Yusuke Tone, Fukuoka (JP); Masaaki Momoe, Fukuoka (JP); Kazuya Esaki, Fukuoka (JP); Masaki Mori, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 10 days.

(21) Appl. No.: 17/591,782

(22) Filed: Feb. 3, 2022

(65) Prior Publication Data

US 2022/0316200 A1 Oct. 6, 2022

(30) Foreign Application Priority Data

Mar. 30, 2021 (JP) ..... 2021-058732

(51) Int. Cl.
*E03D 11/13* (2006.01)

(52) U.S. Cl.
CPC ..... *E03D 11/13* (2013.01)

(58) Field of Classification Search
CPC ..... E03D 11/13; E04F 13/0883; A47B 2096/209; A47B 88/95
USPC ..... 4/420; 292/251.5; 312/204, 265.5–265.6
See application file for complete search history.

(56) References Cited

U.S. PATENT DOCUMENTS 2,693,382 A * 11/1954 Teetor ..... E05C 19/16 292/251.5
3,346,993 A * 10/1967 Johnson ..... E06B 3/4609 49/419
3,697,363 A * 10/1972 Martinez ..... A47B 96/205 312/265.5
4,058,335 A * 11/1977 Abe ..... E05C 19/16 428/900
4,090,265 A * 5/1978 Baus ..... E05D 15/08 4/557

(Continued)

FOREIGN PATENT DOCUMENTS

JP 2010-194157 9/2010
JP 2017-020568 1/2017

(Continued)

OTHER PUBLICATIONS

Japanese Office Action for Japanese Patent Application No. 2021-058732 dated Jul. 12, 2022.

(Continued)

*Primary Examiner* — David P Angwin
*Assistant Examiner* — William R Klotz
(74) *Attorney, Agent, or Firm* — Amin, Turocy & Watson, LLP

(57) ABSTRACT

A flush toilet includes a toilet body that includes a bowl part that receives waste, a functional part that is provided on a back side of the toilet body, a panel member that covers a side surface of the functional part, a first holding part that adsorbs and holds the toilet body and a side surface of the panel member by magnetic force, and a second holding part that adsorbs and holds the functional part and a side surface of the panel member by magnetic force. The panel member is capable of being slid frontward, backward, upward, and downward in a state where the panel member is adsorbed and held by the first holding part and the second holding part.

4 Claims, 4 Drawing Sheets

(56) References Cited

U.S. PATENT DOCUMENTS

| | | | | | |
|---|---|---|---|---|---|
| 4,287,676 | A * | 9/1981 | Weinhaus | G09F 7/18 | 40/661.01 |
| 4,575,966 | A * | 3/1986 | Gerritsen | E06B 7/16 | 49/404 |
| 5,496,104 | A * | 3/1996 | Arnold | E05D 7/04 | 312/204 |
| 5,782,512 | A * | 7/1998 | Cargnoni | E05C 19/16 | 292/DIG. 60 |
| 2003/0091784 | A1* | 5/2003 | Nykamp | B32B 3/06 | 108/50.11 |
| 2009/0255050 | A1* | 10/2009 | Lebrun | A47K 3/161 | 4/584 |

FOREIGN PATENT DOCUMENTS

| | | |
|---|---|---|
| JP | 2018-119371 | 8/2018 |
| JP | 2020-165173 | 10/2020 |

OTHER PUBLICATIONS

Japanese Notice of Allowance for Japanese Patent Application No. 2021 -058732 dated Sep. 27, 2022.

* cited by examiner

FLUSH TOILET

CROSS-REFERENCE TO RELATED APPLICATION(S)

The present application claims the benefit of priority to Japanese Patent Application No. 2021-058732 filed on Mar. 30, 2021, the entire contents of which Japanese Patent Application are incorporated by reference in the present application.

FIELD

A disclosed embodiment(s) relate(s) to a flush toilet.

BACKGROUND

For a flush toilet with a functional part that is covered by a panel member, a method has conventionally been known that uses magnetic force in order to hold the panel member on the flush toilet (see, for example, Japanese Patent Application Publication No. 2020-165173).

A method that uses magnetic force in Japanese Patent Application Publication No. 2020-165173 is a method that uses two pairs of magnets so as to fix a panel member on a toilet body. A first pair of magnets is provided on a back end part of a side surface of a toilet body and a front end part of an inner side surface of a panel member. A second pair of magnets is provided on a back surface of a functional part, that is, a back surface of a flush toilet, and a back end part of an inner side surface of a panel member.

However, in such a method, a holding surface for a toilet body and a panel member is not flush with a holding surface for a functional part and the panel member, so that it is not possible to hold the panel member on the toilet body and subsequently slide it in frontward and backward directions. Hence, positioning of a panel member relative to a toilet body and/or a functional part is difficult.

SUMMARY

A flush toilet according to an aspect of an embodiment includes a toilet body that includes a bowl part that receives waste, a functional part that is provided on a back side of the toilet body, a panel member that covers a side surface of the functional part, a first holding part that adsorbs and holds the toilet body and a side surface of the panel member by magnetic force, and a second holding part that adsorbs and holds the functional part and a side surface of the panel member by magnetic force, wherein the panel member is capable of being slid frontward, backward, upward, and downward in a state where the panel member is adsorbed and held by the first holding part and the second holding part.

BRIEF DESCRIPTION OF DRAWING(S)

DESCRIPTION OF EMBODIMENT(S)

First Embodiment

Hereinafter, an outline of a flush toilet 1 according to a first embodiment will be explained with reference to the accompanying drawing(s).

Figure 1:
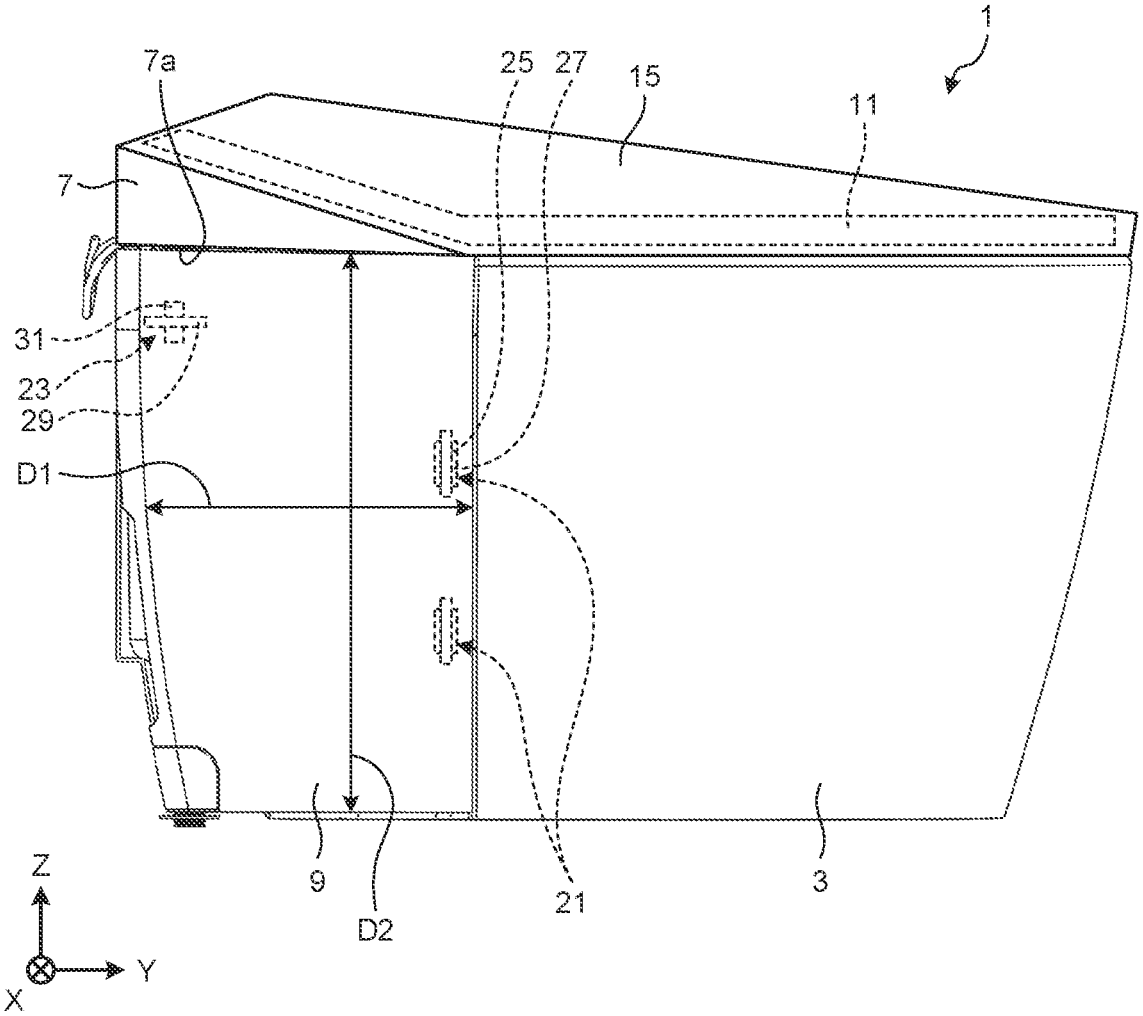
FIG. 1 is a side view of a flush toilet according to a first embodiment.

Additionally, in respective figurers that include FIG. 1, a three-dimensional orthogonal coordinate system that includes a Z-axis where a vertically upward (an upward) direction is provided as a positive direction may be illustrated for explanatory convenience. In such a case, a positive direction of an X-axis, a negative direction of the X-axis, a positive direction of a Y-axis, a negative direction of the Y-axis, a positive direction of a Z-axis, and a negative direction of the Z-axis are defined as being leftward, rightward, frontward, backward, upward, and downward, and further, X-axis directions, Y-axis directions, and Z-axis directions are referred to as leftward and rightward directions, frontward and backward directions, and upward and downward directions.

Figure 2:
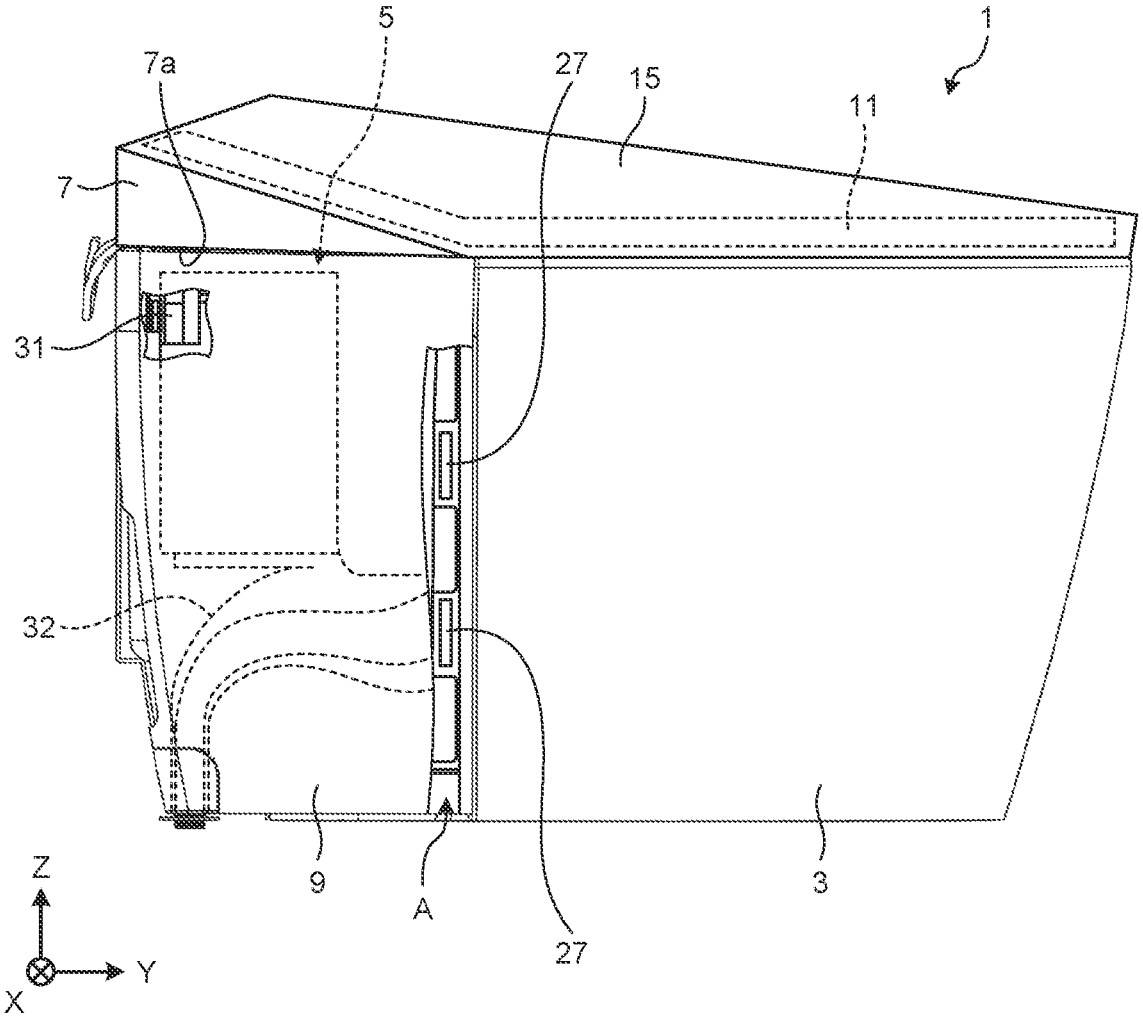
FIG. 2 is a side view where a part of a panel member and the like of a flush toilet according to a first embodiment are omitted.

As illustrated in FIG. 1 and FIG. 2, the flush toilet 1 includes a toilet body 3, a functional part 5, a sanitary washing device 7, a panel member 9, and a toilet seat part 11. The toilet body 3 is made of a ceramic. Additionally, the toilet body 3 that is made of a ceramic is not limiting where, for example, it may be made of a resin or may be a combination of a ceramic and a resin. FIG. 1 is a side view of the flush toilet 1 according to a first embodiment. FIG. 2 is a side view where a part of the panel member 9 and the like of the flush toilet 1 according to a first embodiment are omitted.

In the flush toilet 1, when the panel member 9 is attached thereto and when position adjustment of the panel member 9 relative to the toilet body 3 is executed, the panel member 9 is capable of being slid relative to the toilet body 3 and the functional part 5, for example, as indicated by arrows D1 and D2 in FIG. 1, so that it is possible to readily execute such position adjustment.

The toilet body 3 has a bowl part (non-illustrated) and a drainage water trap pipeline 32.

The functional part 5 is provided on a back side of the toilet body 3. The functional part 5 executes water supply to a bowl part of the toilet body 3 and/or the sanitary washing device 7. The functional part 5 includes a water storage tank (non-illustrated), a pressurization pump (non-illustrated), and the like. In the functional part 5, for water supply, washing water that is stored in a water storage tank is pressurized by a pressurization pump, so that a high flow volume thereof is spouted from a jet water spout port (non-illustrated) to a bowl part.

The sanitary washing device 7 is provided in such a manner that a bottom surface 7*a* thereof slopes downward toward the toilet body 3. Specifically, the bottom surface 7*a* of the sanitary washing device 7 slopes downward in such a manner that a height thereof decreases toward a front side thereof. The sanitary washing device 7 is provided with a private part washing device (non-illustrated) that includes a nozzle device (non-illustrated) that jets washing water toward a private part of a user on an upper side of a bowl part. Furthermore, the sanitary washing device 7 is provided with a water storage part (non-illustrated) that stores washing water that is supplied to a private part washing device, a heater (non-illustrated) that warms washing water in the water storage part to suitable temperature so as to provide warm water, a ventilation fan (non-illustrated), a deodorization fan (non-illustrated), a hot air fan (non-illustrated), a control part (non-illustrated) that controls each of these parts, and the like.

The panel member 9 for preventing an external obstacle on and/or sewage penetration to the functional part 5 is provided on a back side of the toilet body 3 and a side surface of the functional part 5.

The toilet seat part 11 is arranged on an upper part of the toilet body 3 and a user is seated thereon in a case where the flush toilet 1 is used thereby. The toilet seat part 11 is rotated around a back side thereof as a point of support so as to be capable of being opened and closed.

A lid part 15 is arranged on an upper part of the toilet body 3 similarly to the toilet seat part 11 and covers an upper surface of the toilet body 3 that includes a bowl part thereof from an upper side thereof. The lid part 15 is rotated around a back side thereof as a point of support so as to be capable of being opened and closed, similarly to the toilet seat part 11. Additionally, the lid part 15 in a closed state thereof covers an upper surface of the toilet body 3 from an upper side thereof and covers the toilet seat part 11 from an upper side thereof.

A bowl part is a site that receives waste and is formed into a recess shape. A rim part (non-illustrated) is formed on an upper edge part of a bowl part. A rim part has a rim water spout port (non-illustrated) that spouts washing water. Washing water that is spouted from a rim water spout port of a rim part flows along an upper edge part of a bowl part so as to form a swirling flow in the bowl part. Additionally, a water conduit (non-illustrated) that is formed on an upstream side is connected to a rim water spout port and washing water from a washing water supply device (non-illustrated) is supplied through the water conduit.

Figure 3:
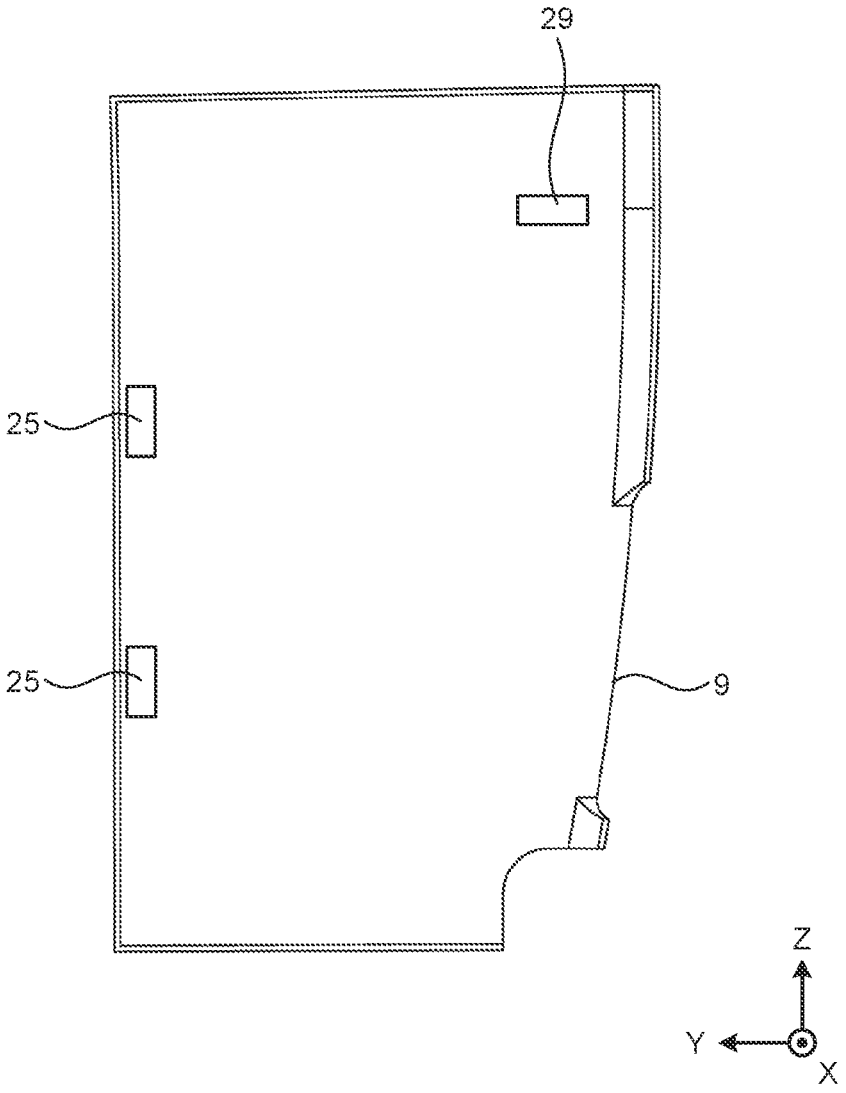
FIG. 3 is a diagram where a side of a panel member according to a first embodiment is viewed from an inside thereof.

Next, attachment of a panel member 9 to a toilet body 3 will be explained with reference to FIG. 1 to FIG. 3. FIG. 3 is a diagram where a side of the panel member 9 according to a first embodiment is viewed from an inside thereof.

A flush toilet 1 includes a first holding part 21 and a second holding part 23. The first holding part 21 adsorbs and holds a side surface of the panel member 9 and the toilet body 3 by magnetic force and the second holding part 23 adsorbs and holds a functional part 5 and a side surface of the panel member 9 by magnetic force.

The first holding part 21 will be explained in detail. The first holding part 21 is composed of a magnet 25 and a metal plate 27 that is a magnetic body that is adsorbed by magnetic force thereof. The first holding part 21 is provided on a boundary part A between the toilet body 3 and the panel member 9. The boundary part A refers to a place where, when the panel member 9 is properly placed on the toilet body 3, the panel member 9 overlaps with the toilet body 3. The boundary part A refers to a place where, when a side of the toilet body 3 is viewed, a side surface of the toilet body 3 that is changed at a gentle curvature from a front side thereof has a great curvature change on a back side of the toilet body 3, in detail, a place that has a step that is dented toward an inside of the toilet body 3.

The magnet 25 is attached to the panel member 9. For example, The magnet 25 is bonded to the panel member 9. The magnet 25 is provided at two places on a side of a front end of an inner side surface of the panel member 9, that is, near a boundary between the toilet body 3 and the panel member 9. Two places for arrangement of the magnet 25 are one place in an interval between an upper end and a center of the panel member 9 and one place in an interval between a lower end and the center of the panel member 9.

A shape of the magnet 25 is a cuboid with a small thickness. In detail, the magnet 25 is provided in such a manner that a short side of the magnet 25 is provided along frontward and backward directions. That is, the magnet 25 is arranged in such a manner that a length thereof in upward and downward directions is greater than a length thereof in frontward and backward directions. Furthermore, a thickness of the magnet 25 is less than a depth of a step that is formed on the boundary part A.

Then, the metal plate 27 will be explained. The metal plate 27 is attached to the toilet body 3. The metal plate 27 is attached to a side surface of the toilet body 3 at the boundary part A. The metal plate 27 is provided at two places on the boundary part A of the toilet body 3. Two places for arrangement of the metal plate 27 are one place in an interval between an upper end and a center of the boundary part A and one place in an interval between a lower end and the center of the boundary part A. In a case where the panel member 9 is attached thereto at a proper position, the metal plate 27 is arranged so as to face the magnet 25. In the toilet body 3, a place where the metal plate 27 is placed is dented inward and a part of the metal plate 27 is embedded in such a dented place, so that the metal plate 27 is fixed thereon. The metal plate 27 may be bonded to the toilet body 3.

A shape of the metal plate 27 is a cuboid with a small thickness. The metal plate 27 is provided in such a manner that a short side of the metal plate 27 is provided along frontward and backward directions. That is, the metal plate 27 is arranged in such a manner that a length thereof in upward and downward directions is greater than a length thereof in frontward and backward directions. When a side of the toilet body 3 is viewed, a length of the metal plate 27 in frontward and backward directions is less than or equal to a length of the boundary part A in frontward and backward directions. A length of the metal plate 27 in upward and downward directions is substantially equal to a length of the magnet 25 in upward and downward directions. Additionally, the metal plate 27 may be provided with a structure like a single plate that is elongated upward and downward.

The first holding part 21, that is, the magnet 25 and the metal plate 27 is/are provided with a shape(s) in upward and downward directions that is/are longer than that/those in frontward and backward directions. Thereby, at a place where the panel member 9 is held by the first holding part 21, a distance where the panel member 9 is capable of being held thereby for sliding of the panel member 9 relative to the toilet body 3 in upward and downward directions is greater than that for sliding of the panel member 9 relative thereto in frontward and backward directions. A place where the panel member 9 is held by the first holding part 21 is a vicinity of a boundary between the toilet body 3 and the panel member 9 where a gap between the toilet body 3 and the panel member 9 at the boundary in frontward and backward directions is set so as to be as small as possible in view of health and/or a design thereof. When the panel member 9 is held by the first holding part 21, a worker first executes positioning thereof in frontward and backward directions and holding thereof so as to clear a gap between the toilet body 3 and the panel member 9. Herein, at a boundary between the toilet body 3 and the panel member 9, guiding of the panel member 9 to a proper position in frontward and backward directions is executed visually, so that positioning thereof in frontward and backward directions is executed smoothly. After positioning of the panel member 9 in frontward and backward directions is executed, position adjustment thereof in upward and downward directions is executed, so that it is desirable that an interval where holding thereof is capable of being executed, in upward and downward directions, is large at a place where it is held by the first holding part 21. Hence, the magnet 25 and the metal plate 27 are provided with a shape(s) in upward and downward directions that is/are longer than that/those in frontward and backward directions. Therefore, it is possible for a worker to readily move the panel member 9 to a proper position, so that it is possible to improve accuracy of positioning of the panel member 9 to the proper position.

The second holding part 23 will be explained in detail. The second holding part 23 is composed of a magnet 29 and a metal plate 31 that is a magnetic body that is adsorbed by magnetic force thereof. When the panel member 9 is properly placed on the toilet body 3, the second holding part 23 is positioned in an upper area of the panel member 9.

As illustrated in FIG. 3, the magnet 29 is attached to the panel member 9. For example, the magnet 29 is bonded to the panel member 9. The magnet 29 is arranged at one place on a side of an upper end of an inner side surface of the panel member 9 and on a back side of the panel member 9. A shape of the magnet 29 is a cuboid with a small thickness. The magnet 29 is provided with a horizontally long shape where a length thereof in frontward and backward directions is greater than a length thereof in upward and downward directions.

Then, the metal plate 31 will be explained. The metal plate 31 is attached to a side surface of the functional part 5. For example, the metal plate 31 is bonded to the functional part 5. The metal plate 31 is provided with a vertically long shape where a length thereof in upward and downward directions is greater than a length thereof in frontward and backward directions. When a side of the toilet body 3 is viewed, the magnet 29 and the metal plate 31 are provided with a shape(s) of a cross of the magnet 29 and the metal plate 31. Additionally, a relationship between lengths of the magnet 29 and the metal plate 31 may be opposite thereto. That is, the magnet 29 may be provided with a vertically long shape where a length thereof in upward and downward directions is greater than a length thereof in frontward and backward directions and the metal plate 31 may be provided with a horizontally long shape where a length thereof in frontward and backward directions is greater than a length thereof in upward and downward directions.

Thereby, when a worker executes position adjustment while the panel member 9 is slid relative to the functional part 5, it is possible to extend an area where the magnet 29 contacts the metal plate 31 so as to be capable of maintaining a holding state of the panel member 9 as compared with a case where directions of long sides of the magnet 29 and the metal plate 31 are identical. Thereby, even in a case where a worker causes the panel member 9 to contact a place that greatly shifts from a proper position, it is possible to provide a state where the panel member 9 is held.

A distance where holding is capable of being executed by the second holding part 23 in frontward and backward directions is greater than a distance where holding is capable of being executed by the first holding part 21 in frontward and backward directions. In such a configuration, in a case where positioning in frontward and backward directions is first executed so as to clear a gap between the toilet body 3 and the panel member 9, it is possible to absorb, even if the panel member 9 and the functional part 5 are adsorbed and held by the second holding part 23 that is highly influenced by a dimension tolerance thereof in frontward and backward directions, such a dimension tolerance. Hence, it is possible for a worker to attach the panel member 9 to the toilet body 3 and the functional part 5 while a positional shift between the panel member 9 and the toilet body 3 at the boundary part A is suppressed. A reason why the second holding part 23 is readily influenced by a dimension tolerance thereof is that the metal plate 31 of the second holding part 23 is provided on a part of the functional part 5 that is arranged so as to be continuous with a drainage water trap pipeline 32 that is made of a ceramic and hence an attachment position of the metal plate 31 is a place where a large manufacturing error that is associated with manufacturing of a ceramic from a front end of the toilet body 3 to the drainage water trap pipeline 32 is provided.

Additionally, a number and/or arrangement of the magnet 25, 29 and the metal plate 27, 31 is/are not limited thereto and is/are appropriately changed by a magnitude of magnetic force thereof, a weight of the panel member 9, and/or the like. Furthermore, a length of the metal plate 27, 31 is not limited thereto and any shape and/or number thereof is/are provided as long as the metal plate 27, 31 is provided at a position of the magnet 25, 29 at a time when the panel member 9 is attached to the toilet body 3 at a proper position. Furthermore, the magnet 25, 29 may be included in the toilet body 3 and the metal plate 27, 31 that is a magnetic body may be included in the panel member 9. Furthermore, a magnet may be used instead of the metal plate 27, 31 that is a magnetic body.

A flow of attaching of the panel member 9 to the toilet body 3 will be explained. First, a worker attaches the magnet 25 of the panel member 9 to the metal plate 27 that is provided on the boundary part A so as to be suitable in frontward and backward directions. A reason why positioning of the panel member 9 in frontward and backward directions at the boundary part A is first executed is that the toilet body 3 at the boundary part A is hidden by the panel member 9 so as to provide a state that is invisible from a user and thereby the toilet body 3 and the panel member 9 seem to be formed continuously so that hiding of the toilet body 3 at the boundary part A that is important for ensuring a design thereof is executed reliably. Then, the panel member 9 is slid in upward and downward directions relative to the toilet body 3 in such a manner that the panel member 9 coincides with the toilet body 3 in upward and downward directions. Herein, position adjustment is executed in such a manner that an upper surface of the panel member 9 and an upper surface of the toilet body 3 are provided with linear shapes in a side view.

The first holding part 21 and the second holding part 23 are provided on a side surface of the flush toilet 1, so that it is possible for a worker to execute position adjustment of the panel member 9 to a proper position relative to the toilet body 3 while the panel member 9 is slid, in a state where the panel member 9 and the toilet body 3 are held thereby and a state where the panel member 9 and the functional part 5 are held thereby. It is possible to execute position adjustment in a state where the panel member 9 is held, so that it is possible to suppress an amount of movement of the panel member 9 even in a case where a worker applies too much power thereto for sliding. Furthermore, even in a case where a worker slips his or her hand(s) from the panel member 9, it is possible to hold the panel member 9 on the toilet body 3 or the functional part 5. Hence, it is possible to prevent contact between the panel member 9 and the toilet body 3, the functional part 5, or ground.

Second Embodiment

Figure 4:
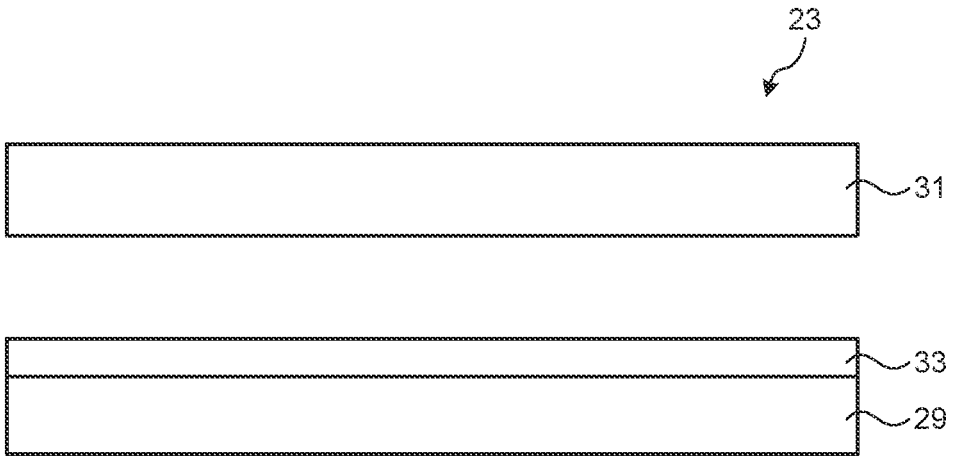
FIG. 4 is an explanatory diagram that illustrates a holding power adjustment part of a flush toilet according to a second embodiment.

Next, a flush toilet 1 according to a second embodiment will be explained. An explanation for a configuration that is identical to that of the first embodiment will be omitted. As illustrated in FIG. 4, the flush toilet 1 includes a holding power adjustment part 33. FIG. 4 is an explanatory diagram that illustrates the holding power adjustment part 33 of the flush toilet 1 according to a second embodiment.

The holding power adjustment part 33 is provided on at least one of a first holding part 21 and a second holding part 23. The holding power adjustment part 33 adjusts holding power for at least one of a toilet body 3 and a functional part 5 and a panel member 9. Herein, an example will be explained where the holding power adjustment part 33 is provided on a magnet 29 of the second holding part 23.

The holding power adjustment part 33 adjusts magnetic force of the second holding part 23. The holding power adjustment part 33 is, for example, a film.

For example, in a case where magnetic force of the magnet 29 is weak, the holding power adjustment part 33 that has a greater friction coefficient, the holding power adjustment part 33 of a material with a high magnetic permeability, and/or the holding power adjustment part 33 with a large thickness is/are selected, so that it is possible to prevent the panel member 9 from detaching and dropping from the toilet body 3 and/or the functional part 5. Furthermore, for example, in a case where magnetic force of a magnet 25, 29 is strong so that greater power is needed in order to slide the panel member 9, the holding power adjustment part 33 that has a less friction coefficient, the holding power adjustment part 33 of a material with a low magnetic permeability, and/or the holding power adjustment part 33 with a small thickness is/are selected in order to decrease holding power, so that it is possible to readily execute position adjustment that is caused by sliding.

Additionally, the holding power adjustment part 33 is not limited to a film shape and may be provided integrally with the magnet 29 or a method that applies surface treatment to the magnet 29 may also be provided. Furthermore, the holding power adjustment part 33 may be provided on a metal plate 31. Furthermore, the holding power adjustment part 33 may be provided on the first holding part 21 by a method that is similar to that of the second holding part 23.

Figure 5:
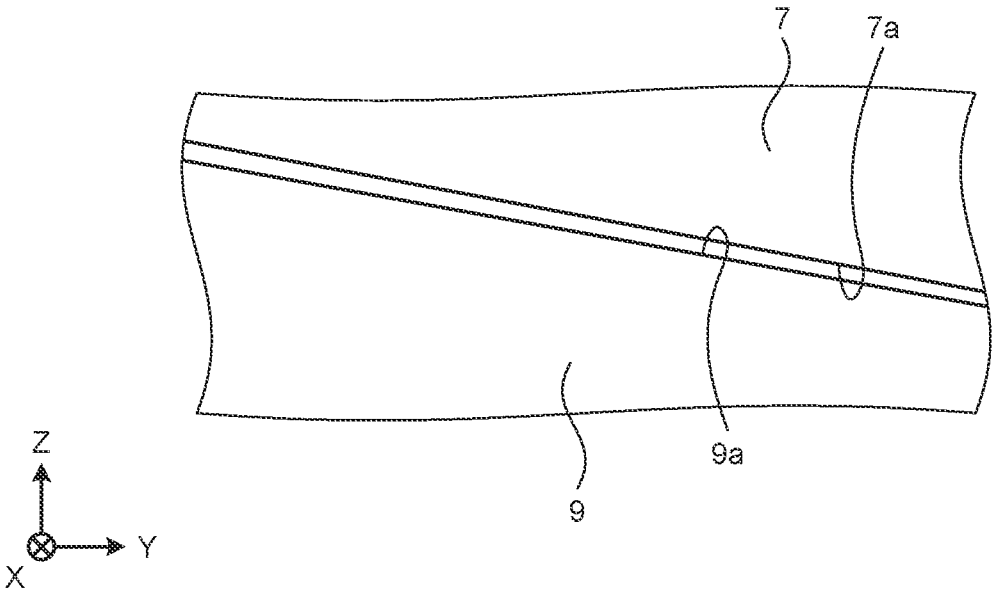
FIG. 5 is a side view that illustrates a relationship between a sanitary washing device and a panel member of a flush toilet according to a variation.

Additionally, as illustrated in FIG. 5, an upper surface 9*a* of the panel member 9 may slope downward in such a manner that a height thereof decreases toward a front side thereof. FIG. 5 is a side view that illustrates a relationship between a sanitary washing device 7 and a panel member 9 of a flush toilet 1 according to a variation. Specifically, an upper surface 9*a* of the panel member 9 may slope downward at an angle that is substantially identical to that of a downward slope of a bottom surface 7*a* of the sanitary washing device 7. Thereby, it is possible to decrease a gap between the panel member 9 and the sanitary washing device 7 after attachment of the panel member 9. Furthermore, when position adjustment is executed while the panel member 9 is slid in a front direction relative to a toilet body 3 and/or a functional part 5, the position adjustment is executed while contact between the bottom surface 7*a* of the sanitary washing device 7 and the upper surface 9*a* of the panel member 9 is executed, and hence, the panel member 9 is guided by the sanitary washing device 7, so that it is possible to readily arrange the panel member 9 at a proper position.

Next, a flush toilet 1 according to a variation will be explained. An explanation for a configuration that is identical to that of the first embodiment will be omitted. In the first embodiment, when the panel member 9 is properly placed on the toilet body 3, the second holding part 23 is positioned in an upper area of the panel member 9, the metal plate 31 is arranged on the functional part 5, and the magnet 29 is arranged at one place on a side of an upper end of an inner side surface of the panel member 9 and on a back side of the panel member 9.

In the flush toilet 1 according to a variation, a second holding part (non-illustrated) is arranged at one place on the toilet body (non-illustrated) in the first embodiment or a place that extends from the toilet body in the first embodiment, on a back side of a first holding part (non-illustrated).

For example, a toilet body extends from a boundary part (non-illustrated) to a back end part of a panel member (non-illustrated) in an upper area of the panel member. A metal plate (non-illustrated) of a second holding part (non-illustrated) may be arranged at a place that extends from a boundary part of a toilet body to a back end part of a panel member in an upper area thereof (a place where the functional part 5 is arranged in the first embodiment).

Furthermore, for example, a toilet body extends from a drainage water trap pipeline (non-illustrated) to a position of a first holding part in leftward and rightward directions in a middle area of a panel member. A metal plate of a second holding part may be arranged at a place that extends from a drainage water trap pipeline to a first holding part in leftward and rightward directions.

Furthermore, for example, a toilet body extends from a boundary part to a back end part of a panel member in a lower area thereof. A metal plate of a second holding part may be arranged at a place that extends from a boundary part of a toilet body to a back end part of a panel member in a lower area thereof. That is, a configuration of a metal plate that is attached to a functional part (non-illustrated) like the first embodiment is not limiting.

Furthermore, even if a configuration of a first holding part (non-illustrated) of the flush toilet 1 according to a variation is applied to a configuration of a second holding part (non-illustrated) and the configuration of the second holding part is applied to the configuration of the first holding part, it is possible to be capable of sliding like an embodiment as described above and thereby readily execute position adjustment.

An aspect of the present embodiment aims to hold a panel member and subsequently causes it to be capable of being slid upward, downward, frontward, and backward so as to facilitate positioning thereof.

A flush toilet according to an aspect of an embodiment is characterized by including a toilet body that has a bowl part that receives waste, a functional part that is provided on a back side of the toilet body, a panel member that covers a side surface of the functional part, a first holding part that adsorbs and holds the toilet body and a side surface of the panel member by magnetic force, and a second holding part that adsorbs and holds the functional part and a side surface of the panel member by magnetic force, wherein the panel member is capable of being slid frontward, backward, upward, and downward in a state where it is adsorbed and held by the first holding part and the second holding part.

In such a configuration, it is possible for a first holding part and a second holding part to form an identical plane that is provided on a side surface of a flush toilet, so that it is possible for a worker to execute, in a state where a panel member is held on a toilet body and a functional part, position adjustment thereof to a proper position thereof while the panel member is slid relative to the toilet body and the functional part. Furthermore, it is possible to execute such position adjustment in such a holding state, so that it is possible to suppress an amount of movement of a panel member even in a case where a worker applies too much power thereto for sliding thereof. Furthermore, even in a case where a worker slips his or her hand(s) from a panel member, it is possible to hold the panel member on a toilet body or a functional part. That is, it is possible to prevent contact between a panel member and a toilet body, a functional part, ground, or the like.

Furthermore, it is characterized in that the first holding part is provided on a boundary part between the toilet body and the panel member, and a distance where holding is capable of being executed by the first holding part in upward and downward directions is greater than a distance where holding is capable of being executed thereby in frontward and backward directions in a state where the panel member is adsorbed and held by the first holding part and the second holding part.

In such a configuration, when a worker executes such position adjustment while a panel member is slid relative to a toilet body, a distance where a first holding part is capable of being held in upward and downward directions is long, so that it is possible to improve accuracy of positioning of the panel member at a proper position in upward and downward directions.

Furthermore, it is characterized in that a distance where holding is capable of being executed by the second holding part in frontward and backward directions is greater than a distance where holding is capable of being executed by the first holding part in frontward and backward directions.

In such a configuration, in a case where positioning thereof in frontward and backward directions is first executed so as to clear a gap between a toilet body and a panel member, it is possible to absorb, even if the panel member and a functional part are adsorbed and held by a second holding part that is highly influenced by a dimension tolerance thereof in frontward and backward directions, such a dimension tolerance. Hence, it is possible for a worker to suppress a positional shift between a panel member and a toilet body at a boundary part and attach the panel member to the toilet body and a functional part.

Furthermore, it is characterized in that the second holding part has a magnet that is provided on one of the panel member and the functional part and a magnetic body that is provided on another of the panel member and the functional part, a length of the one of the magnet and the magnetic body in upward and downward directions is greater than a length thereof in frontward and backward directions, and a length of the another of the magnet and the magnetic body in upward and downward directions is less than a length thereof in frontward and backward directions.

In such a configuration, when a worker executes such position adjustment while a panel member is slid relative to a functional part, it is possible to extend an area where a magnet contacts a magnetic body so as to be capable of maintaining a holding state of the panel member, as compared with a case where a longitudinal direction of the magnet and a longitudinal direction of the magnetic body are provided as identical directions. Thereby, even in a case where a worker causes a panel member to contact a place that greatly shifts from a proper position thereof, it is possible to provide a state where the panel member is held.

Furthermore, it is characterized by including a holding power adjustment part that adjusts holding power for at least one of the toilet body and the functional part and the panel member.

In such a configuration, it is possible to increase an option of a usable magnet. For example, in a case where magnetic force of a magnet is weak, a holding power adjustment part with a greater friction coefficient, a holding power adjustment part of a material with a high magnetic permeability, a thickness of a holding power adjustment part, and/or the like is/are selected, so that it is possible to improve an adhesion holding power for a panel member. Furthermore, for example, in a case where magnetic force of a magnet is strong, a holding power adjustment part of a material that decreases friction force, a holding power adjustment part of a material with a low magnetic permeability, a thickness of a holding power adjustment part, and/or the like is/are selected in order to decrease adsorption holding power, so that it is possible to readily execute position adjustment of a panel member by sliding thereof.

Furthermore, it is characterized by including a sanitary washing device that is provided on an upper side of the functional part, wherein a bottom surface of the sanitary washing device is provided to slope downward from a back side to a front side thereof in an interval in frontward and backward directions where at least the panel member is provided, and an upper surface of the panel member is provided to slope downward from a back side to a front side thereof.

In such a configuration, it is possible to decrease a gap between a panel member and a sanitary washing device after position adjustment of the panel member to a proper position. Furthermore, when such position adjustment is executed while a panel member is slid in a forward direction relative to a toilet body and a functional part, the position adjustment is executed while a top surface of the panel member contacts a bottom surface of a sanitary washing device, and hence, the panel member is guided by the sanitary washing device, so that it is possible to readily place the panel member at a proper position.

In a flush toilet according to the present embodiment, a panel member is held and subsequently is caused to be capable of being slid upward, downward, frontward, and backward so as to facilitate positioning thereof.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet, comprising:

a toilet body that includes a bowl part that receives waste;

a functional part that is provided on a back side of the toilet body;

a panel member that covers a side surface of the functional part;

a first holding part that adsorbs and holds the toilet body and a side surface of the panel member by magnetic force; and a second holding part that adsorbs and holds the functional part and the side surface of the panel member by magnetic force, wherein the panel member is capable of being slid frontward, backward, upward, and downward in a state where the panel member is adsorbed and held by the first holding part and the second holding part, a distance where holding is capable of being executed by the second holding part in frontward and backward directions is greater than a distance where holding is capable of being executed by the first holding part in frontward and backward directions, the second holding part includes a magnet that is provided on one of the panel member and the functional part and a magnetic body that is provided on the other of the panel member and the functional part, a length of one of the magnet and the magnetic body in upward and downward directions is greater than a length thereof in frontward and backward directions, and a length of the other of the magnet and the magnetic body in upward and downward directions is less than a length thereof in frontward and backward directions.

2. The flush toilet according to claim 1, wherein the first holding part is provided on a boundary part between the toilet body and the panel member, and a distance where holding is capable of being executed by the first holding part in upward and downward directions is greater than a distance where holding is capable of being executed thereby in frontward and backward directions in a state where the panel member is adsorbed and held by the first holding part and the second holding part.

3. The flush toilet according to claim 1, further comprising a holding power adjustment part that adjusts holding power for at least one of the toilet body and the functional part and the panel member.

4. The flush toilet according to claim 1, further comprising a sanitary washing device that is provided on an upper side of the functional part, wherein a bottom surface of the sanitary washing device is provided to slope downward from a back side to a front side thereof in an interval in frontward and backward directions where at least the panel member is provided, and an upper surface of the panel member is provided to slope downward from a back side to a front side thereof.

* * * * *